United States Patent [19]

Potthoff

[11] Patent Number: 5,020,446

[45] Date of Patent: Jun. 4, 1991

[54] THREE-DIMENSIONAL SINGLE-WHEEL SUSPENSION FOR WHEELS OF RAILED VEHICLES

[75] Inventor: Heinrich Potthoff, Hattingen, Fed. Rep. of Germany

[73] Assignee: Bergische Stahl-Industrie, Remscheid, Fed. Rep. of Germany

[21] Appl. No.: 436,592

[22] Filed: Nov. 15, 1989

[30] Foreign Application Priority Data

Nov. 17, 1988 [DE] Fed. Rep. of Germany ..... 3838845

[51] Int. Cl.[5] ..... B61F 15/00

[52] U.S. Cl. ..... 105/218.1; 105/224.05; 105/169; 105/199.1

[58] Field of Search ..... 105/218.1, 224.1, 169, 105/170, 165, 180, 177, 199.5, 199.1, 206.1, 209, 218.2, 219, 223, 224.05, 224.06; 280/661, 702, 707, 704, 91

[56] References Cited

U.S. PATENT DOCUMENTS

| | | | |
|---|---|---|---|
| 205,390 | 6/1878 | Hurd | 105/169 |
| 307,017 | 10/1884 | Cleveland | 105/170 |
| 601,231 | 3/1898 | Blackburn | 105/170 |
| 981,131 | 1/1911 | Spangler | 105/199.5 |
| 1,317,518 | 9/1919 | MacFarren | 105/170 |
| 2,644,697 | 7/1953 | Peterson | 105/169 |
| 4,371,191 | 2/1983 | Goldberg et al. | 280/707 |
| 4,440,419 | 4/1984 | Kosak et al. | 280/661 |
| 4,515,390 | 5/1985 | Greenberg | 280/772 |
| 4,650,213 | 3/1987 | Fujita et al. | 280/707 |
| 4,700,972 | 10/1987 | Young | 280/707 |
| 4,732,407 | 3/1988 | Oyama et al. | 280/707 |
| 4,826,206 | 5/1989 | Immega | 280/707 |
| 4,838,574 | 6/1989 | Baraszu | 280/707 |
| 4,903,983 | 2/1990 | Fukushima et al. | 280/707 |

FOREIGN PATENT DOCUMENTS

| | | | |
|---|---|---|---|
| 639523 | 4/1962 | Canada | 105/169 |
| 1064977 | 9/1959 | Fed. Rep. of Germany | 105/180 |
| 1078882 | 3/1960 | Fed. Rep. of Germany | 280/124 F |
| 3477 | 3/1978 | Fed. Rep. of Germany | 105/165 |
| 0131808 | 6/1987 | Japan | 280/702 |

*Primary Examiner*—Douglas C. Butler
*Assistant Examiner*—Mark T. Le
*Attorney, Agent, or Firm*—Robert W. Becker & Associates

[57] ABSTRACT

A three-dimensional single-wheel suspension for wheels of a railed vehicle, where a wheel unit, including a wheel, a wheel mounting, a non-rotating wheel carrier, and a drive and/or braking mechanism, is provided to execute steering and/or cushioning movements relative to the vehicle. The wheel carrier is movably connected to the vehicle via linkage rods, and is also connected to the wheel carrier of the oppositely disposed wheel. The point of connection of at least one of the linkage rods to the vehicle is adjustable as a function of such vehicle states including forward or rearward travel, straight-ahead travel or travel through a curve, and braking or driving, and/or including a function of the state of wear of the wheel.

8 Claims, 1 Drawing Sheet

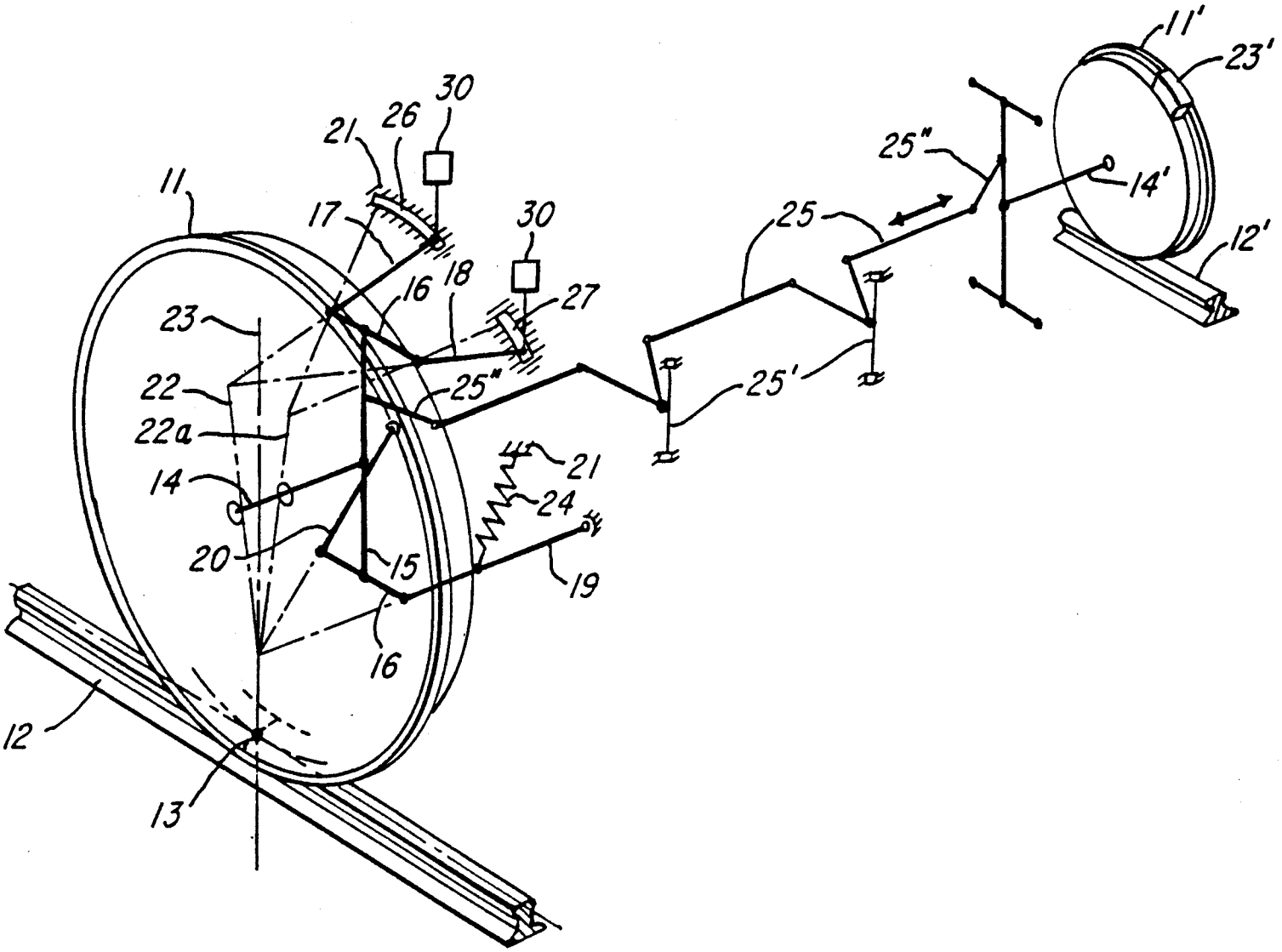
11'
23'
12'
14'
25"
25
25'
30
27
21
24
19
30
18
25"
26
16
15
16
21
17
23
22
22a
14
20
11
13
12

THREE-DIMENSIONAL SINGLE-WHEEL SUSPENSION FOR WHEELS OF RAILED VEHICLES

BACKGROUND OF THE INVENTION

The present invention relates to a three-dimensional single-wheel suspension for wheels of a railed vehicle having a mass, where a wheel unit including a wheel, the wheel mounting, the non-rotating wheel carrier means, and possibly a drive and/or braking mechanism, is provided to execute steering and/or cushioning movements relative to the vehicle. The wheel carrier means is connected with the wheel carrier means of an oppositely disposed wheel via a connecting rod arrangement in the form of a tie bar arrangement and via intermediate elements and is movably connected to the vehicle via linkage means, the ends of which are provided with joints.

Up to now, no railed vehicles have become known where the individual wheel is disposed or connected to the vehicle via linkage means or similar elements. However, efforts exist, while avoiding a bogie, to leave as much space as possible between the wheels and to improve the travel or operation of the wheels on the rails by automatic adjustment of the wheels tangential to the rails, and to improve the noise and wear characteristics of the railed vehicle wheels, whereby the non-cushioned mass can be reduced, which has a favorable effect upon the driving comfort.

It is therefore an object of the present invention to avoid the heretofore known drawbacks of bogies and rigid axles, and furthermore to provide a wheel connection to the railed vehicle that brings about the aforementioned improvements.

BRIEF DESCRIPTION OF THE DRAWING

This object, and other objects and advantages of the present invention, will appear more clearly from the following specification in conjunction with the accompanying schematic drawing, which illustrates one exemplary embodiment of the inventive single-wheel suspension.

SUMMARY OF THE INVENTION

The present invention is characterized primarily in that the point of connection of at least one of the linkage means to the vehicle is adjustable as a function of the state of the vehicle, such as forward or rearward travel, straight-ahead travel or travel through a curve, and braking or driving, and/or as a function of the state of wear of the wheel. The linkage means are advantageously disposed essentially on that side of the wheel unit that is remote from the center of the vehicle, and the instantaneous guide axis, which is determined by the arrangement of the linkage means, is disposed at least approximately in a plane that, when the wheel is not pivoted, is disposed perpendicular to the axis of rotation and also contains the point of contact of wheel to rail (the wheel support point).

The advantage of the inventive single-wheel suspension is primarily that no bogie is required, and hence considerable weight of non-cushioned masses is eliminated, which again is to the benefit of a quiet operation of the rail vehicle. With the present invention, due to the elimination of the rigid axis, it is furthermore possible to considerably lower the floor of the vehicle (low-floor vehicle), which facilitates entry and exit from the vehicle and thus increases the comfort of passengers. Due to the guidance of the wheel on linkage means, and the thereby formed virtual pivot axis, all of the installation space within the wheel is available for the drive means, for example in the form of a wheel hub motor that is connected to a planetary gear mechanism.

Since the self-guiding wheels are always positioned tangential to the rails, the squeaking in tight curves of the rails, as is encountered with bogies, is eliminated; this also has a favorable effect upon the wear characteristics of the wheels.

Further specific features of the present invention will be described in detail subsequently.

DESCRIPTION OF PREFERRED EMBODIMENTS

Referring now to the drawing in detail, illustrated is a rail wheel 11 that rolls upon a rail 12, where it defines the wheel support point 13. The wheel 11 rotates on an axle 14 that is fixedly connected with a non-rotating wheel carrier means 15, 16. Drive and/or braking mechanisms 23' can also be disposed in a known manner on the wheel 11 respectively 11'.

The wheel unit, which comprises the wheel 11, the wheel mounting on the axle 14, and the non-rotating wheel carrier means 15, 16, is connected to the vehicle 21 via guide means 26, 27 as means provided for adjusting the point of connection of at least one of the linkage means 17, 18 included with four connecting rod or linkage means 17, 18, 19, and 20 in such a way that the points of connection to the vehicle are spaced further apart than the distance to the part 16 of the wheel carrier means 15, 16. The linkage means 17–20 are essentially disposed on that side of the wheel 11 that faces the center of the vehicle, whereby the instantaneous guide axis 22, which is defined by the illustrated location in the arrangement of the linkage means 17–20, is disposed at least approximately in the plane 23, which when the wheel 11 is not pivoted is disposed perpendicular to the axis of rotation or axle 14, and which also contains the point of contact between the wheel and the rail, i.e. the wheel support point 13. Disposed on the linkage means 19 is a spring 24 that is supported on the vehicle 21. In addition, a tie bar arrangement 25 including intermediate elements 25', 25'' is connected to the wheel carrier means 15, 16 and is also connected to the wheel carrier means of the oppositely disposed wheel 11' upon a rail 12' with an axle 14' for the wheel 11'.

Pursuant to the present invention, the two linkage means 17 and 18 are connected to the vehicle 21 in such a way that their points of connection to the vehicle can each be shifted in a respective guide means 26, 27 horizontally and approximately parallel to the longitudinal axis of the vehicle. The two guide means 26 and 27 have the same length and are disposed in such a way that even when the linkage means 17 and 18 are adjusted as shifted into the respective end position, the guide axis **22*a* is still disposed in the plane 23**.

Mechanisms known in the vehicle industry, such as springs 24 and/or shock absorption elements, are disposed on one or more of the linkage means 17–20.

The adjusting of the point of connection via shifting of the linkage means 17 and 18 in the guide means 26, 27 can be effected by electrical, pneumatic, and/or hydraulic mechanisms 30 as a function of state of the vehicle including the direction of travel, longitudinal or transverse accelerations or decelerations, and/or the load state of the vehicle.

It is to be understood that all of the linkage means 17–20 could be disposed in guide means, so that the connection points of all of the linkage means could be shifted. Although the expense is greater, this has the advantage over the adjustment or shifting of only two linkage means that a lesser shifting of the connection points is sufficient in order to achieve the same magnitude pitch of the virtual guide axis.

The present invention is, of course, in no way restricted to the specific disclosure of the specification and drawing, but also encompasses any modifications within the scope of the appended claims.

What I claim is:

1. A three-dimensional single-wheel suspension system for a railway vehicle having a body, comprising:

a wheel unit including a wheel mounted on a non-rotating wheel carrier means, said wheel carrier means being connected to another wheel carrier means of an oppositely disposed wheel by a connecting rod arrangement in the form of a tie bar arrangement which includes intermediate elements connected to said wheel carrier means, each said wheel carrier means also being movably connected to the body of said railway vehicle via linkage means, further improvements comprising:

said linkage means including linkage members, at least two of said linkage members having ends shiftably connected to the body of said railway vehicle via guide means mounted on the body of said railway vehicle, said guide means being provided for allowing the ends of said at least two linkage members to move relative to said body of said railway vehicle as a function of at least one of the following states of said railway vehicle: forward travel, rearward travel, straight ahead travel, travel through a curve, braking, driving and wear condition of the wheels of said railway vehicle, said wheels always being positioned tangential to rails to eliminate squeaking in narrow curves of the rails, to reduce wear on said wheels and to eliminate the weight of non-cushioned mass of said railway vehicle.

2. A three-dimensional single-wheel suspension system for a railway vehicle having a body, comprising:

a wheel unit including a wheel mounted on a non-rotating wheel carrier means, said wheel carrier means being connected to another wheel carrier means of an oppositely disposed wheel by a connecting rod arrangement in the form of a tie bar arrangement which includes intermediate elements connected to said wheel carrier means, each said wheel carrier means also being movably connected to the body of said railway vehicle via linkage means, further improvements comprising:

said linkage means including linkage members, at least two of said linkage members having ends shiftably connected to the body of said railway vehicle via guide means mounted on the body of said railway vehicle, said guide means being provided for allowing the ends of said at least two linkage members to move relative to said body of said railway vehicle as a function of at least one of the following states of said railway vehicle: forward travel, rearward travel, straight ahead travel, travel through a curve, braking, driving and wear condition of the wheels of said railway vehicle, each said guide means being in the form of an elongated slot.

3. A three-dimensional single-wheel suspension system according to claim 2, in which spring means is provided on at least one of said linkage members to absorb wheel load.

4. A three-dimensional single-wheel suspension system according to claim 2, in which shock absorption means is provided on at least one of said linkage members.

5. A three-dimensional single-wheel suspension system according to claim 2, in which at least one of spring means and shock absorption means is provided between said wheel carrier means and said body of said railway vehicle.

6. A three-dimensional single-wheel suspension according to claim 2, in which each said linkage means is disposed on one side of an associated wheel that faces a central portion of the railway vehicle, said linkage means including an instantaneous guide axis defined by a line interconnecting intersecting points of imaginary lines extending from ends said linkage member, said instantaneous guide axis being disposed approximately in a plane which is perpendicular to an axis of rotation of an associated wheel of said railway vehicle and which plane also contains a point of contact of said associated wheel and a rail.

7. A three-dimensional single-wheel suspension system according to claim 2, which includes one of electrical, pneumatic and hydraulic mechanisms for shifting said ends of said linkage members in said guide means.

8. A three-dimensional single-wheel suspension system according to claim 2, in which the shifting of said ends of said linkage members in said guide means is affected by inertial force of said railway vehicle.

* * * * *